US007458305B1

(12) United States Patent
Horlander et al.

(10) Patent No.: US 7,458,305 B1
(45) Date of Patent: Dec. 2, 2008

(54) MODULAR SAFE ROOM

(75) Inventors: Robert L. Horlander, Bloomington, IN (US); Albert John Degott, Bloomfield, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 470 days.

(21) Appl. No.: 10/774,659

(22) Filed: Feb. 6, 2004

Related U.S. Application Data

(60) Provisional application No. 60/464,694, filed on Apr. 22, 2003.

(51) Int. Cl.
*F41H 5/00* (2006.01)

(52) U.S. Cl. ..... 89/36.01; 89/36.02; 109/1 S; 109/78; 109/79; 52/782.1; 52/800.1

(58) Field of Classification Search ..... 89/36.01, 89/36.02, 36.04, 36.07; 109/1 S, 58, 78, 109/79; 52/79.1, 782.1, 800.1, 800.11, 801.1
See application file for complete search history.

(56) References Cited

U.S. PATENT DOCUMENTS 4,854,248 A * 8/1989 Salzer ..... 109/79
4,928,468 A * 5/1990 Phillips ..... 52/579
5,822,936 A * 10/1998 Bateman ..... 52/281

* cited by examiner

*Primary Examiner*—J. Woodrow Eldred
(74) *Attorney, Agent, or Firm*—Christopher A. Monsey

(57) ABSTRACT

A modular bullet resistant safe room constructed of a plurality of panels and having external seam covers connected to selected panels to cover the seam where joined to adjacent panels. Top panels are oriented transverse to the longitudinal direction of the room, and are of the same width as side panels. In this manner the room may be easily lengthened or shortened by adding or removing top and side panels.

26 Claims, 9 Drawing Sheets

MODULAR SAFE ROOM

CROSS-REFERENCE TO RELATED APPLICATIONS

The present application claims the benefit of priority of U.S. provisional patent application Ser. No. 60/464,694, filed on Apr. 22, 2003, which is hereby expressly incorporated by reference. Said provisional application has been placed under secrecy order and applicants request that said secrecy order be maintained for this non-provisional application.

STATEMENT OF GOVERNMENT INTEREST

The invention described herein may be manufactured and used by or for the Government of the United States of America for government purposes without the payment of any royalties therefor.

BACKGROUND OF THE INVENTION

Safe rooms have been constructed within VIP residences for many years. The rationale of a safe room is to provide a room for personnel in times of danger and which is resistant to small arms fire. In order to meet this objective in the past, these rooms have been constructed during the building of a residence. However, this required knowledge that a VIP would reside in a particular residence prior to its construction. In order to modify an existing residence to include a permanent safe room, drastic design changes or extremely expensive materials and work are required. The desired modification may not be possible or practical, or may not be justified in situations where a VIP may be temporarily housed.

Therefore, it is an object of the present invention to provide a safe room that can be quickly and easily installed, at a relatively low cost, and which is also easily removable.

Modular rooms which can be quickly assembled and disassembled exist, however they are primarily for protection against sever weather conditions. Existing modular rooms cannot withstand small arms fire, particularly at the seams between joined sections.

SUMMARY OF THE INVENTION

The modular safe room in accordance with the present invention includes a plurality of panels of ballistic resistant material, each having an interior side and an exterior side, and selectively joined together at seams to define a room having a front, back, sides and a top. A plurality of seam covers overlap respective ones of the seams, with the seam covers being affixed to selected ones of the panels on the exterior side thereof. The panels include a side panel as well as a top panel, with each being of the same width to facilitate the lengthening or shortening of the room, if required.

BRIEF DESCRIPTION OF THE DRAWINGS

The invention will be better understood, and further objects, features and advantages thereof will become more apparent from the following description of the preferred embodiment, taken in conjunction with the accompanying drawings, in which.

DETAILED DESCRIPTION OF THE PREFERRED EMBODIMENTS

Figure 1:
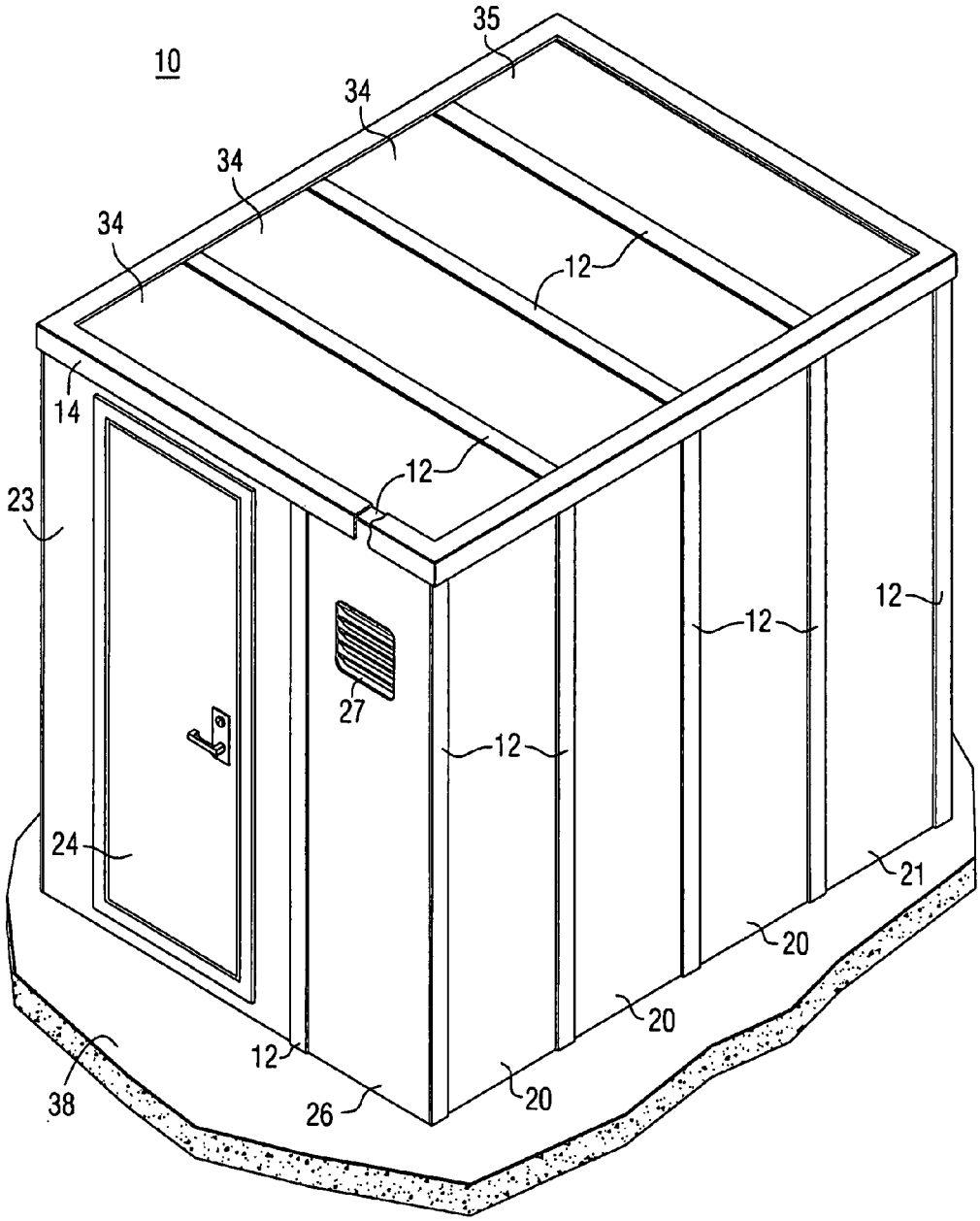
FIG. 1 is an isometric view illustrating the front of the safe room of the present invention.

In the drawings, which are not necessarily to scale, like or corresponding parts are denoted by like or corresponding reference numerals.

Figure 2:
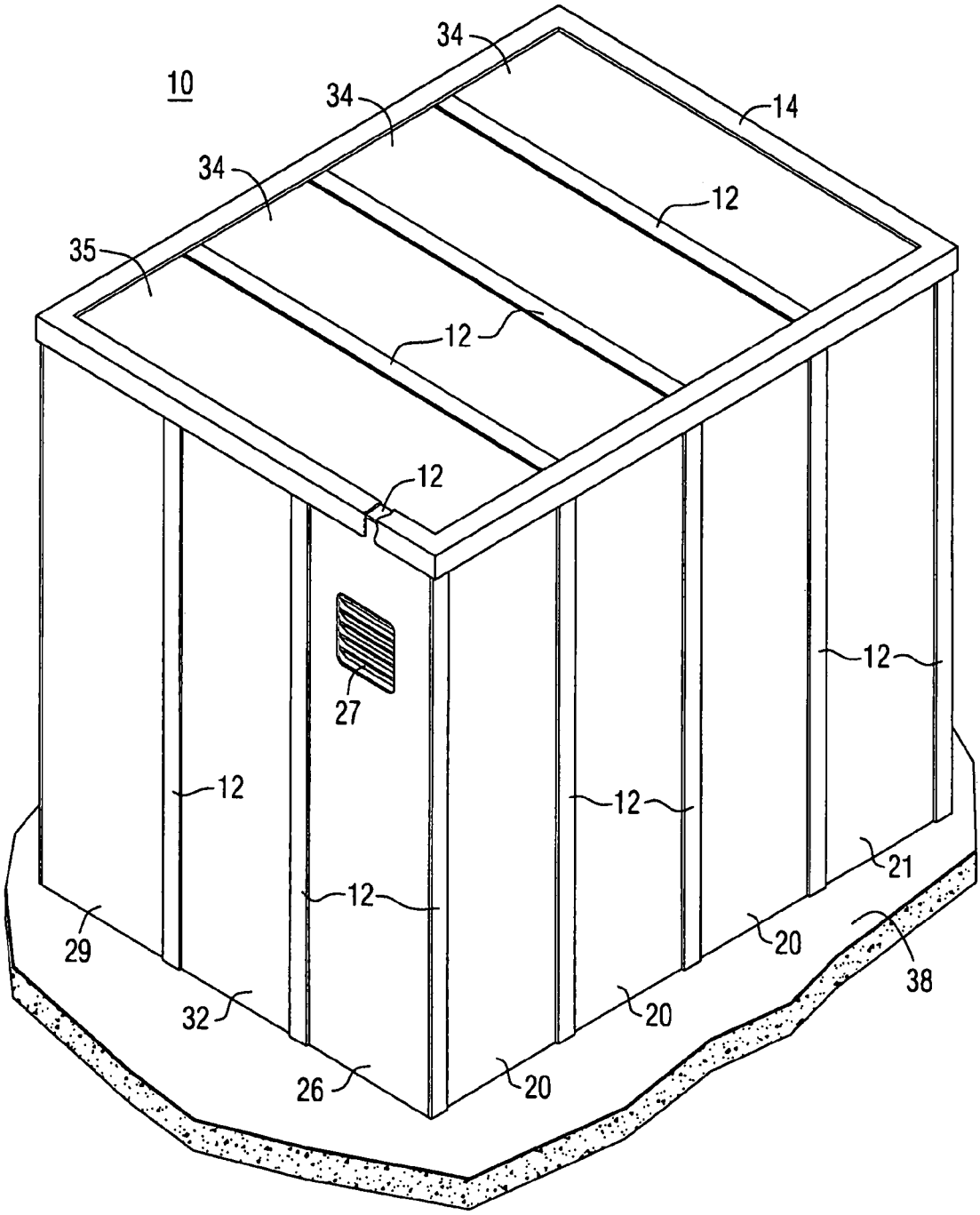
FIG. 2 is an isometric view illustrating the back of the safe room.

Referring now to FIGS. 1 and 2, modular safe room 10 is comprised of a plurality of panels having an interior side and an exterior side and selectively joined together at seams. In accordance with the present invention seam covers 12 are affixed to particular ones of the panels, on the exterior side thereof, to protect the seams from ballistic threats. An optional cap 14 has portions broken away to view the seam covers 12 at the front and back of the structure.

The panels are of a bullet resistant material to meet Level-8 requirements of the UL 752 Standard for Bullet Resistant Equipment, hardened steel ballistic plate being one example. The panels comprising safe room 10 include side panels 20, of a first type, side panels 21, of a second type, door panel 23 with door 24, front panel 26, having a vent 27, aback panels 26, identical in structure to front panel 26 and having an optional vent 27, back panel 29, back center panel 32, top panel 34, of a first type and top panel 35 of a second type.

The safe room 10 extends in a longitudinal direction and the top panels 34, each of which are in a transverse direction, are of the same width as the side panels 20 and are joined to side panels on either side of the room, such that the safe room 10 may be incrementally lengthened or shortened by the installation or removal of side and top panels. The entire modular structure may be easily transported to a site and assembled by two or three persons with hand tools and then secured to a base such as a concrete floor 38. After removal of the threat necessitating the assembly of the safe room 10, it may be easily disassembled and removed from the residence where it was installed.

Figure 3B:
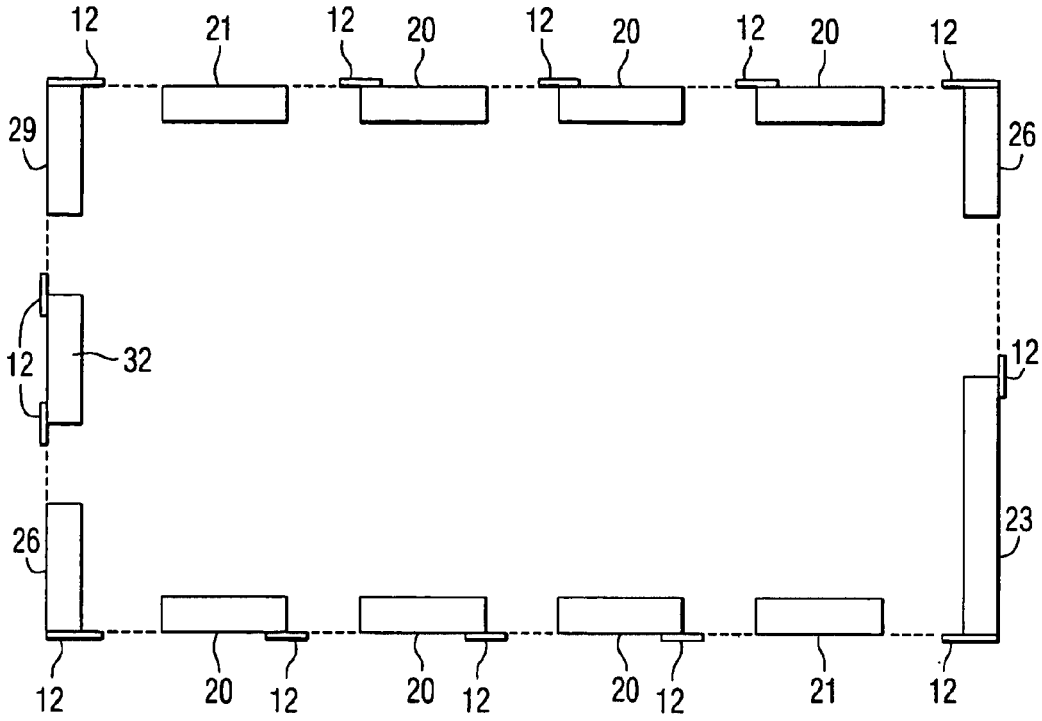
FIG. 3B is an exploded view of FIG. 3A.
Figure 3A:
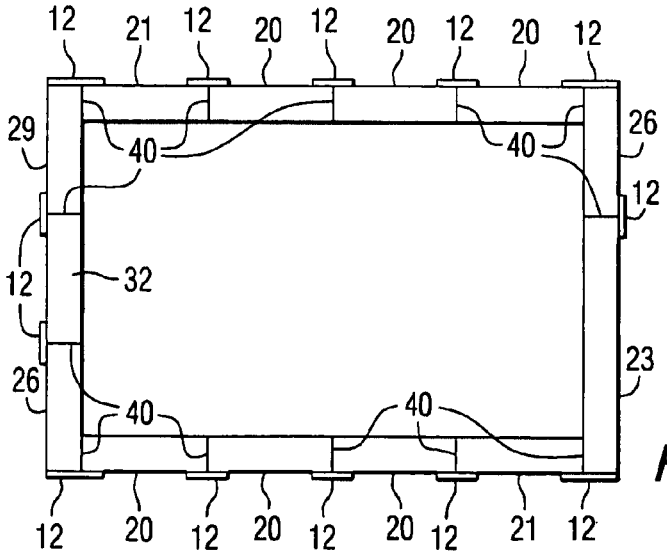
FIG. 3A is a conceptualized presentation of a plan view of the vertical panels of the safe room.

FIG. 3A is a plan view of all of the vertical panels, with the panels shown simply as rectangles. The panels are joined at respective seams 40, each of which is protected on the exterior side by a respective seam cover 12. The panels to which the seam covers 12 are attached is illustrated in FIG. 3B, which is an exploded view. It may be seen that each of the side panels 20 include an attached seam cover 12, whereas one seam of side panel 21, which does not have an affixed seam cover, is protected by a seam cover 12 from an adjacent side panel 20. In the front its other seam is protected by a seam cover 12 on the side of door panel 23, and in the back by a seam cover on the side of back panel 29. Two seam covers 12 on either side of back center panel 32 protect the seams between that panel and the adjacent back panels 26 and 29.

Figure 4B:
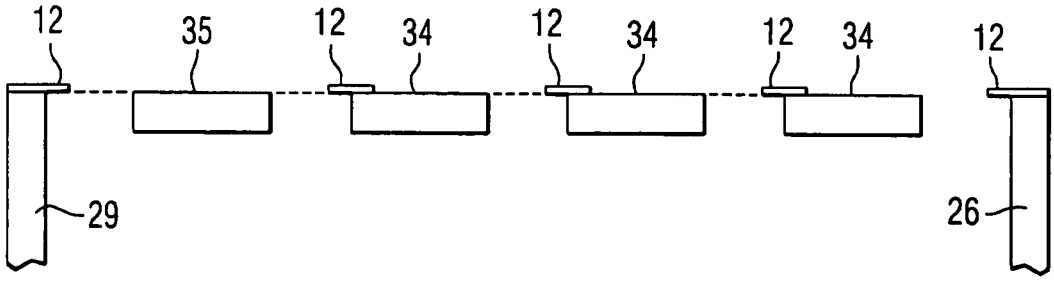
FIG. 4B is an exploded view of FIG. 4A.
Figure 4A:
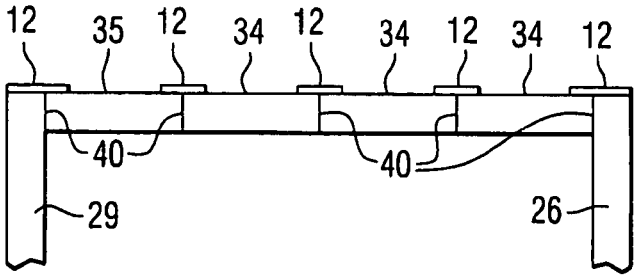
FIG. 4A is a conceptualized presentation of an elevational view of the horizontal panels of the safe room.

FIG. 4A is an elevational view of the horizontal top panels 34 and 35, along with front and back panels 26 and 29, illustrating the covering of all seams 40 by external seam covers 12. The panels to which the seam covers 12 are attached is illustrated in FIG. 4B, which is an exploded view. It may be seen that each of the top panels 34 include an attached seam cover 12, whereas top panel 35, without a seam cover, is protected by a seam cover 12 from an adjacent top panel 34, and its other seam is protected by a seam cover on the top of back panel 29. Although not illustrated, seam covers 12 are also located on the tops of panels 26 and 32 to form a continuous seam cover over the top panel 35.

Figure 5:
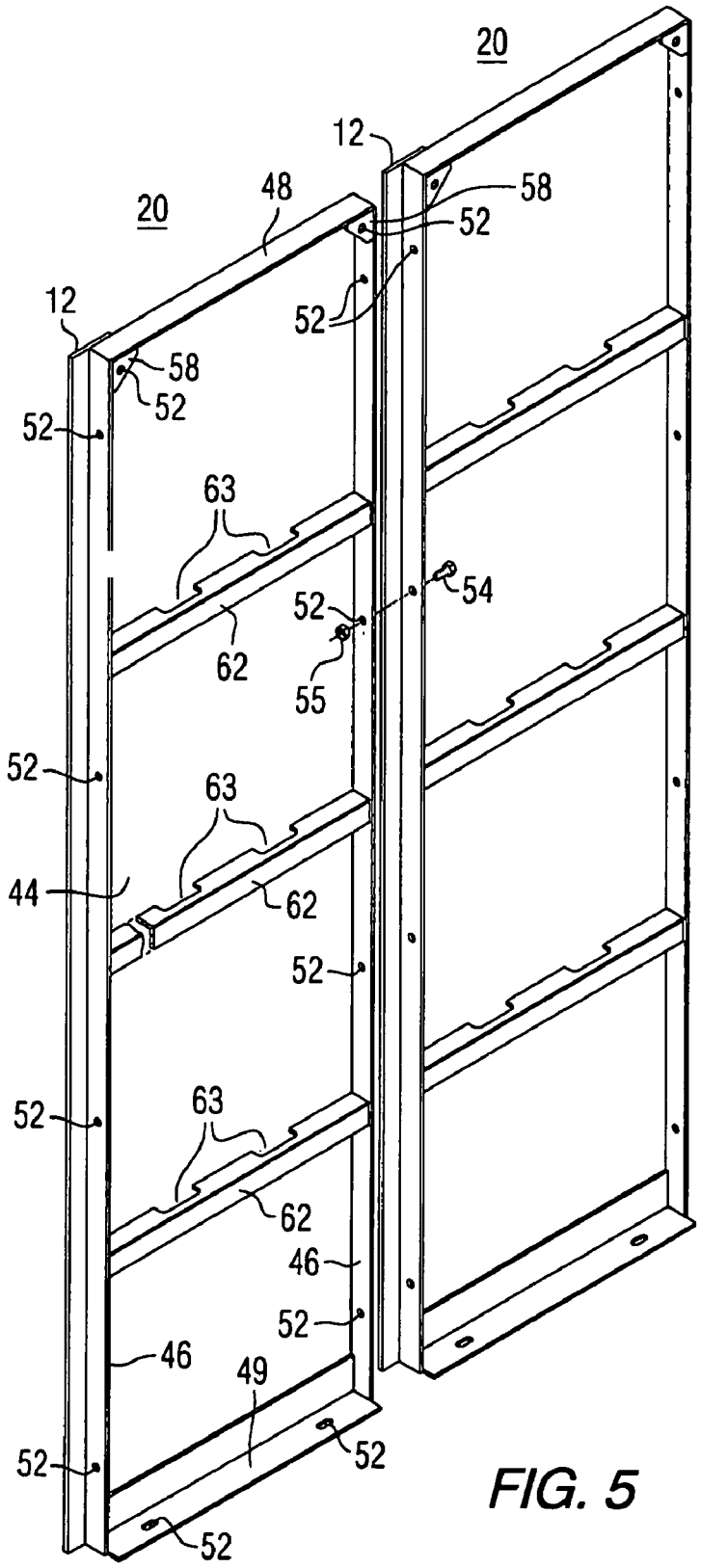
FIG. 5 illustrates two adjacent side panels of the safe room.

FIG. 5 is an exploded view illustrating two adjacent side panels 20. Each fabricated side panel 20 includes a rectangular plate 44 to which is affixed side frame members 46, top frame member 48 and a base member 49 having apertures 52 for securing the structure to the floor. Side frame members 46 include a series of apertures 52 whereby the panels 20 may be joined together by means of fasteners, one of which is illustrated and includes a bolt 54 and nut 55.

Panel 20 also includes gussets 58 having respective apertures 52 for joining to a top panel, as will be seen. Reinforcing angle iron cross bars 62 extend between side frame members 46 and preferably include cutouts 63 adjacent the interior surface of plate 44 for hanging items or for securing ropes or straps. Affixed to the exterior of the panel 20, overlapping an edge thereof, is seam cover 12.

Figure 6:
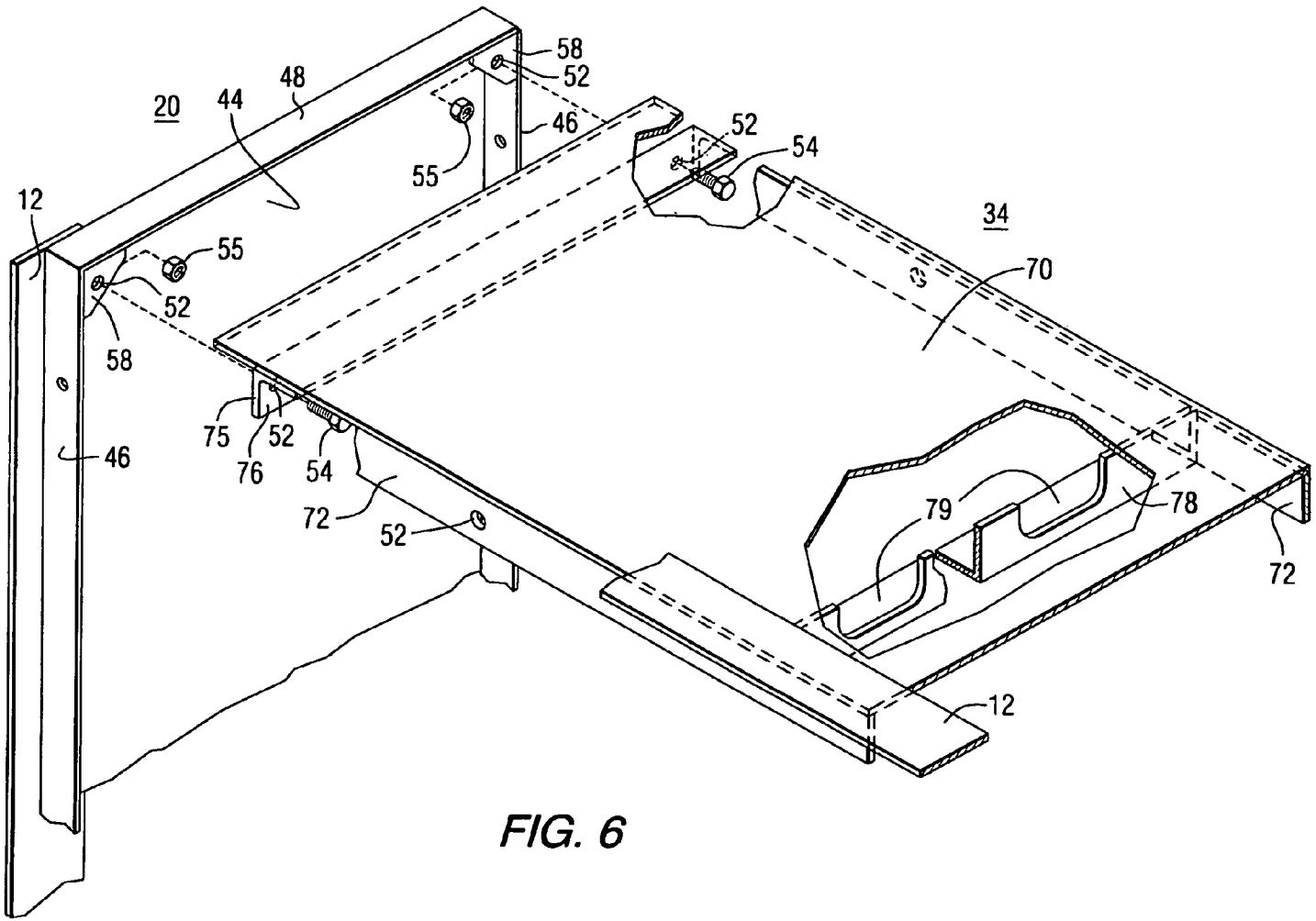
FIG. 6 illustrates the joining of a top panel to a side panel.
Figure 6A:
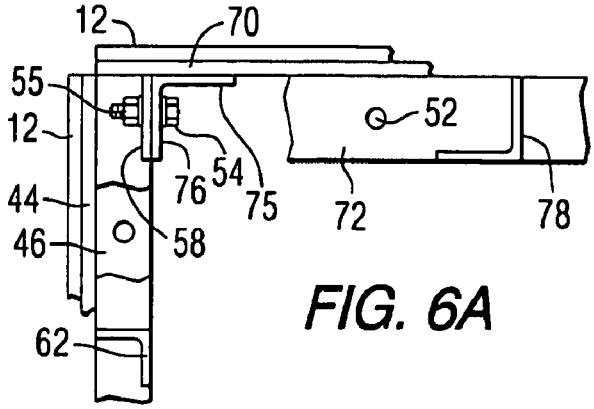
FIG. 6A is a cross-sectional view of the joined panels of FIG. 6.

FIG. 6 illustrates the joining of a top panel 34 to a side panel 20. Top panel 34 includes a plate 70 to which is affixed side frame members 72 having apertures 52 for joining to adjacent top panels, or the three panels at the back of safe room 10, as the case may be. An angle iron 75 is disposed inward from the edge of plate 70 and has a depending side 76 having apertures 52 which line up with apertures 52 in gussets 58 of panel 20 so that bolts 54 may be inserted. Extending between side frame members 72 is a reinforcing angle iron cross bar 78 (one of two) with cutouts 79. FIG. 6A is a side view of the attached panels. The remaining portion of top panel 34, not shown, would be symmetrical with that illustrated, for attachment to a side panel 20 on the other side of the safe room structure.

Figure 7A:
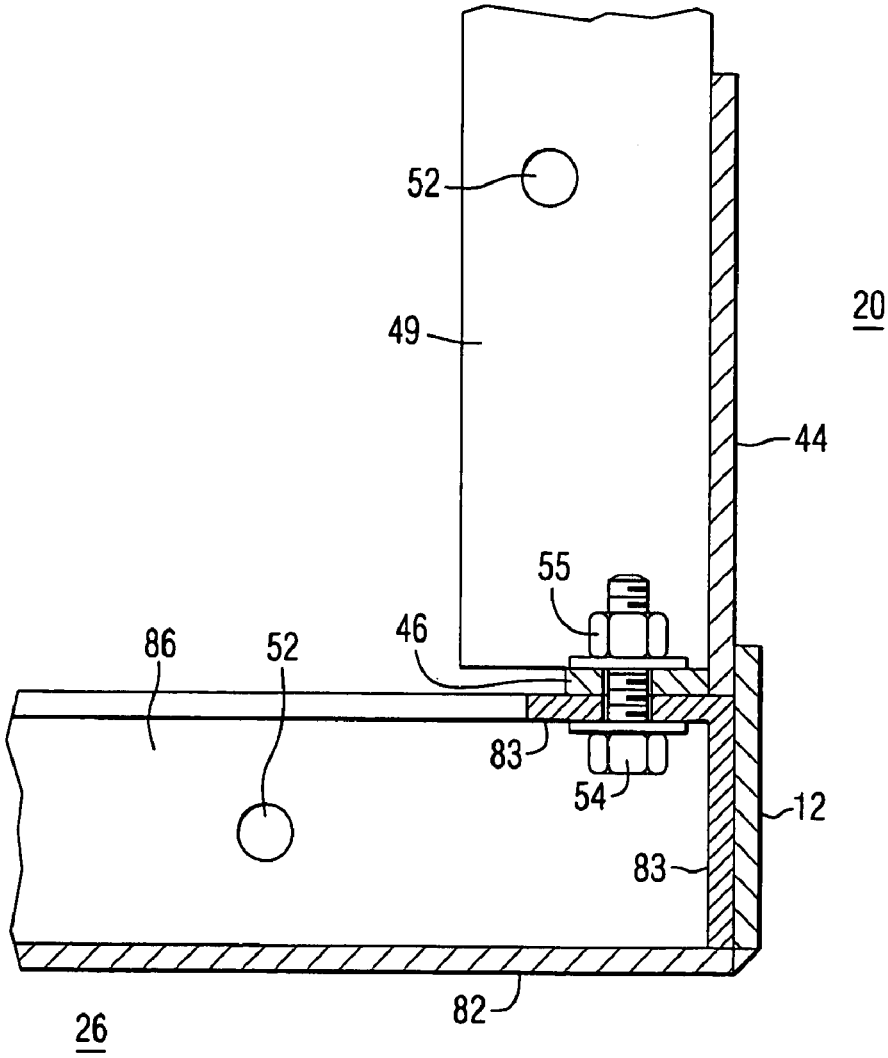
FIG. 7A is a cross-sectional view of joined panels of FIG. 7
Figure 7:
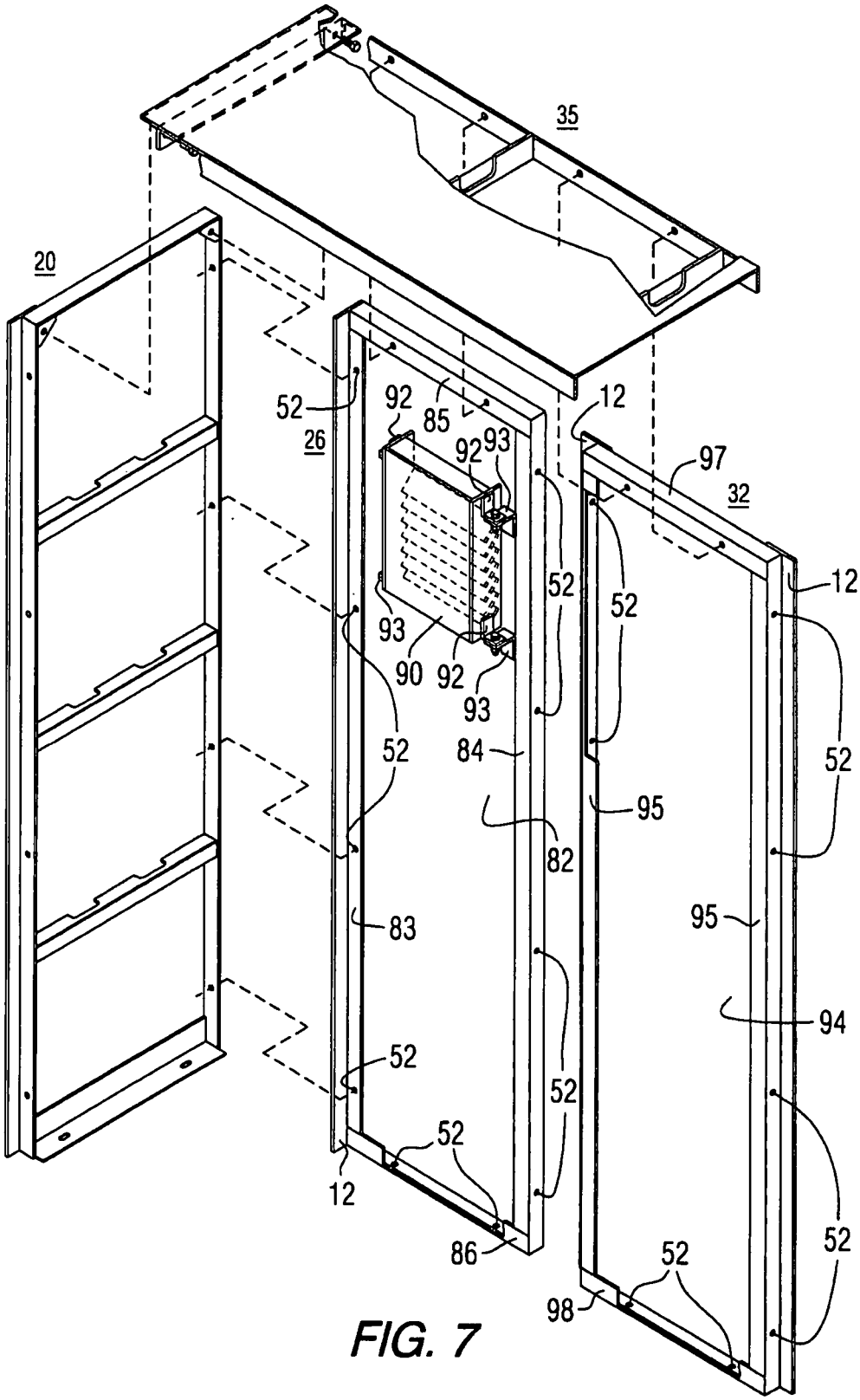
FIG. 7 is an exploded view illustrating the joining of several panels.

FIG. 7 is an exploded view illustrating the joining of side and top panels 20 and 35 to a back panel 26 and back center panel 32. The principles of joining are equally applicable to the remaining back panel 29, as well as to the door and front panels 23 and 26. Back panel 26 includes plate 82 to which is affixed at the edges thereof, side angle irons 83 and 84, top angle iron 85 and base angle iron 86, having a portion broken away to illustrate apertures 52 for securing the panel to the floor.

A series of apertures 52 in the front surface of side angle iron 83 allows connection to side panel 20, and a series of apertures 52 in the side surface of side angle iron 84 allows connection to adjacent back center panel 32. Similarly, apertures 52 in the front surface of top angle iron 85 allow for connection to top panel 35. Back panel 26 and back center panel 32, and back panel 29 (not illustrated) have a seam cover 12 on the top angle iron such that when mated to these panels, top panel 35 slips under these three seam covers. Also illustrated in FIG. 7 is a case 90 which contains the louvered vent 30, and which is mounted by brackets 92 bolted to brackets 93 on plate 82.

The structure of back center panel 32 includes plate 94 to which is affixed at the edges thereof, side angle irons 95, top angle iron 97 and base angle iron 98, having a portion broken away to illustrate apertures 52 for securing the panel to the floor. A series of apertures 52 in the side surface of side angle irons 95 allow for connection to adjacent panels. Back center panel 32, in addition to horizontal seam cover 12 on top of top angle iron 97, also includes vertical seam covers 12 on the exterior of either side of plate 94 to cover the seams between it and adjacent back panels 26 and 29. A cross-sectional plan view of the connection between side panel 20 and back panel 26, is illustrated in FIG. 7A.

Figure 8A:
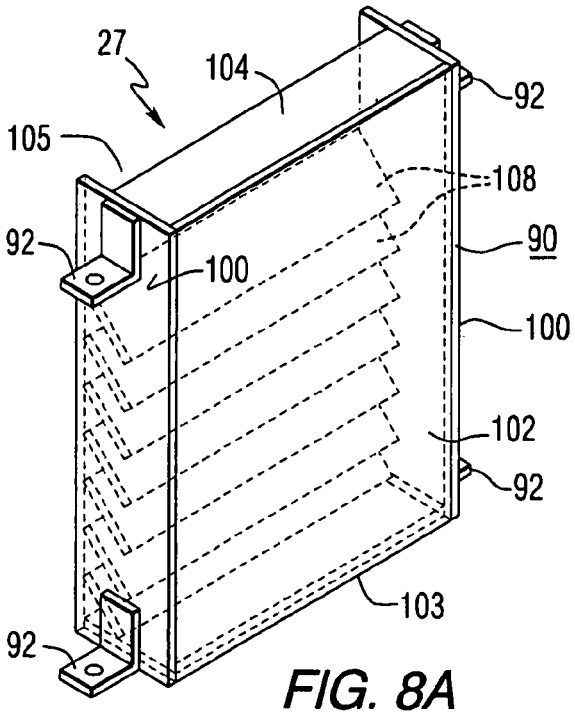
FIG. 8A illustrates a louvered vent.
Figure 8B:
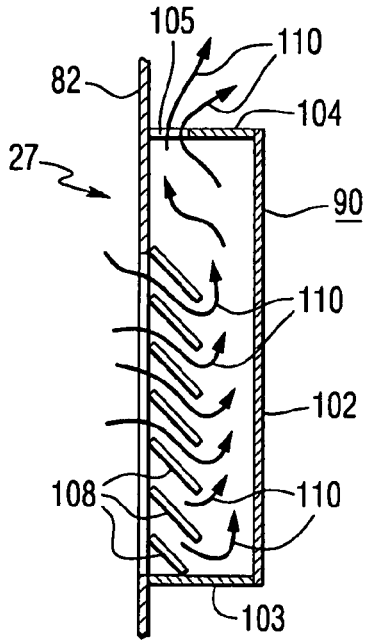
FIG. 8B illustrates the airflow through the vent.

A typical vent 27, illustrated in FIGS. 8A and 8B, includes the case 90 having side walls 100, to which are attached the mounting brackets 92, a back wall 102, a bottom 103 and a top 104. Top 104 is of a smaller dimension than the side walls 100 thereby defining an air gap 105 at the top of case 90. Secured to the side walls 100 are louvers 108, which, in conjunction with back wall 102, prevent small arms fire from entering the interior of the safe room 10, while allowing proper airflow, as represented by arrows 110 (FIG. 8B) down through louvers 108 and up through air gap 105. Vent 27 in front panel 26 may be of identical construction.

Figure 9:
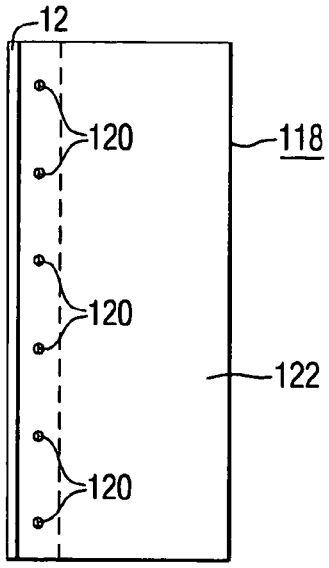
FIG. 9 shows a side panel and its joining to a seam cover.

As previously mentioned the components of the safe room 10 may be fabricated from any material which meets the Level-8 requirements of the UL 752 Standard for Bullet Resistant Equipment. In the example described, hardened steel ballistic plate is shown by way of example. With such material the fabrication of the panels is accomplished by welding the various parts to the plate of the panel. FIG. 9 illustrates a typical plate 118 for any of the panels which include a seam cover 12. In order to preserve the temper of the bullet resistant seam covers it is preferable that they be affixed to the exterior of the plate 118 by the method shown in FIG. 9.

More particularly, a plurality of holes 120 are drilled in the plate 118 near a longitudinal edge and the plate is placed over seam cover 12. A plug welding procedure is then used to affix the seam cover 12. This is accomplished by welding through the holes 120, from the interior side 122 of plate 118, resulting in a secure attachment without directly heating the exterior surface of the seam cover 12.

Figure 10:
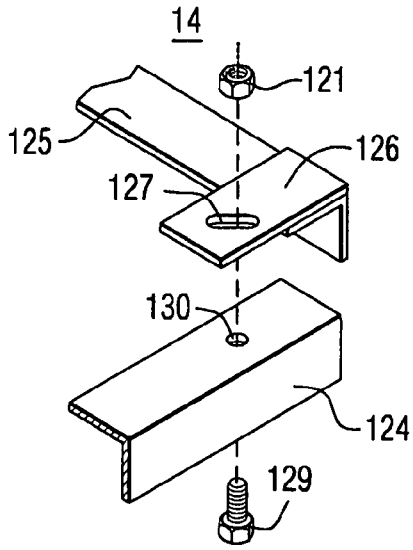
FIG. 10 illustrates the joining of two cap members.

FIG. 10 shows a portion of the optional cap 14 and illustrates the connection of a longitudinal member 124 to a transverse member 125, it being understood that the cap 14 would have two of each such member. A connector plate 126 welded to member 125 includes a slot 127 whereby a bolt 129, passed through aperture 130 in member 124, and through slot 127 may thread into nut 131 to secure the two members. This is done at all four corners whereby the cap 14 may be then be positioned as in FIGS. 1 and 2.

It will be readily seen by one of ordinary skill in the art that the present invention fulfills all of the objects set forth herein. After reading the foregoing specification, one of ordinary skill in the art will be able to effect various changes, substitutions of equivalents and various other aspects of the present invention as broadly disclosed herein. It is therefore intended that the protection granted hereon be limited only by the definition contained in the appended claims and equivalents. Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

What is claimed is:

1. A modular safe room, comprising:

a plurality of panels of ballistic resistant material, each having an interior side and an exterior side, and selectively joined together at seams to define a room having a front, back, sides and a top;

a plurality of seam covers overlapping respective ones of said seams;

said seam covers being affixed to selected ones of said panels on the exterior side thereof;

said room extends in a longitudinal direction;

said panels include side panels and top panels;

a said top panel being of the same width as a said side panel;

each said top panel extending in a transverse direction and joined to side panels on either side of said safe room;

said side panels include a first type having a seam cover affixed to the exterior side thereof, and a second type having no seam cover affixed thereto.

2. A safe room according to claim 1 wherein:

each said side panel includes a plate; and which includes side and top frame members respectively secured to side and top edges of said plate;

a base secured to the bottom interior of said plate and having apertures for securing said panel to a supporting floor with fasteners.

3. A safe room according to claim 2 wherein:

said side panel additionally includes reinforcing members extending between said side frame members.

4. A safe room according to claim 3 wherein:

said reinforcing members include cutouts adjacent the interior surface of said plate.

5. A safe room according to claim 1, wherein:

said panels include a door panel in said front;

said door panel having an integral door of ballistic resistant material.

6. A safe room according to claim 5 wherein:

said panels include a front panel attached to said door panel.

7. A safe room according to claim 6 wherein:

said front panel includes a vent for the passage of air into the interior of said safe room.

8. A safe room according to claim 7 wherein:

said vent is comprised of a case having a plurality of louvers, said case being secured to the interior side of said front panel.

9. A safe room according to claim 1 wherein:

said panels include first and second spaced apart back panels and a back center panel disposed between said back panels;

said back center panel includes two said seam covers, one to cover the seam between said back center panel and said first back panel and the other to cover the seam between said back center panel and said back panel.

10. A safe room according to claim 9 wherein:

one of said back panels includes a vent.

11. A safe room according to claim 1 which includes:

a cap extending around the periphery of said safe room at the top thereof.

12. A safe room according to claim 1 wherein:

said ballistic resistant material is hardened steel ballistic plate.

13. A safe room according to claim 12 wherein:

at least one of said seam covers is plug welded to an associated panel from the interior side of said panel.

14. A safe room, comprising:

a plurality of panels of ballistic resistant material, each having an interior side and an exterior side, and selectively joined together at seams to define a room having a front, back, sides and a top; and a plurality of seam covers overlapping respective ones of said seams;

said seam covers being affixed to selected ones of said panels on the exterior side thereof;

said room extends in a longitudinal direction;

said panels include side panels and top panels;

a said top panel being of the same width as a said side panel;

each said top panel extending in a transverse direction and joined to side panels on either side of said safe room; room;

wherein said top panels include a first type having a seam cover affixed to the exterior side thereof, and a second type having no seam cover affixed thereto.

15. A safe room according to claim 14, wherein:

each said side panel includes a plate; and which includes side and top frame members respectively secured to side and top edges of said plate;

a base secured to the bottom interior of said plate and having apertures for securing said panel to a supporting floor with fasteners.

16. A safe room according to claim 15 wherein:

said side panel additionally includes reinforcing members extending between said side frame members.

17. A safe room according to claim 16 wherein:

said reinforcing members include cutouts adjacent the interior surface of said plate.

18. A safe room according to claim 14, wherein:

said panels include a door panel in said front;

said door panel having an integral door of ballistic resistant material.

19. A safe room according to claim 18 wherein:

said panels include a front panel attached to said door panel.

20. A safe room according to claim 19 wherein:

said front panel includes a vent for the passage of air into the interior of said safe room.

21. A safe room according to claim 20 wherein:

said vent is comprised of a case having a plurality of louvers, said case being secured to the interior side of said front panel.

22. A safe room according to claim 14 wherein:

said panels include first and second spaced apart back panels and a back center panel disposed between said back panels;

said back center panel includes two said seam covers, one to cover the seam between said back center panel and said first back panel and the other to cover the seam between said back center panel and said back panel.

23. A safe room according to claim 22 wherein:

one of said back panels includes a vent.

24. A safe room according to claim 14 which includes:

a cap extending around the periphery of said safe room at the top thereof.

25. A safe room according to claim 14 wherein:

said ballistic resistant material is hardened steel ballistic plate.

26. A safe room according to claim 25 wherein:

at least one of said seam covers is plug welded to an associated panel from the interior side of said panel.

* * * * *